United States Patent [19]

Wolford et al.

[11] 4,273,976

[45] Jun. 16, 1981

[54] PRESSURE RESPONSIVE SWITCH DEVICE

[75] Inventors: Byron F. Wolford, Fergus Falls; John F. Rose, Underwood; James Thunselle, Fergus Falls, all of Minn.

[73] Assignee: Proximity Controls, Inc., Fergus Falls, Minn.

[21] Appl. No.: 45,926

[22] Filed: Jun. 6, 1979

[51] Int. Cl.[3] ..... H01H 35/34

[52] U.S. Cl. ..... 200/83 L; 200/81.4; 200/83 S

[58] Field of Search ..... 200/83 R, 83 A, 83 L, 200/83 S, 83 SA, 81 R, 81.4, 81.5, 61.2, 153 R, 153 T, 290, 302, 303, 5 R, 5 A, 18

[56] References Cited

U.S. PATENT DOCUMENTS

| | | | |
|---|---|---|---|
| 2,628,296 | 2/1953 | Dillman | 200/83 L |
| 2,869,475 | 1/1959 | Bobo | 200/83 L |
| 3,236,963 | 2/1966 | Parmann | 200/67 |
| 3,368,173 | 2/1968 | Wolford | 335/207 |
| 3,786,210 | 1/1974 | Byam | 200/81.4 |
| 3,898,405 | 8/1975 | Weber | 200/83 J |

*Primary Examiner*—Gerald P. Tolin

*Attorney, Agent, or Firm*—Merchant, Gould, Smith, Edell, Welter & Schmidt

[57] ABSTRACT

A switch device (10, 10') which is responsive to various pressures is disclosed. The device (10, 10') includes a housing (18, 18') and plurality of switches (102, 104, 106, 168, 170, 172). A flexible diaphragm (40, 40') is supported external of the housing (18, 18') and has a first face adapted to face a pressure source and a second face facing an external wall (56, 56') of the housing (18, 18'). A plurality of first magnets (46, 48, 50, 182, 184, 186) are connected to the diaphragm at different locations thereon. A plurality of second magnets (108, 110, 112, 174, 176, 178) are supported in the housing and are each connected to one of the switches for activating a respective switch. Each of the second magnets is disposed adjacent one of the first magnets to form a plurality of pairs of first and second magnets whereby the motion of one of the first magnets of one of said pairs causes the second magnet of said last-mentioned pair to move and activate one of the switches to which it is connected. A plurality of biasing springs (74, 76, 150, 152, 164) bias the diaphragm away from the end wall of the housing. Each of the springs provides a biasing force at a different location on the diaphragm and at least two of the biasing springs have different biasing forces for biasing different portions of the diaphragm away from the housing with a different force.

32 Claims, 11 Drawing Figures

FIG. 7
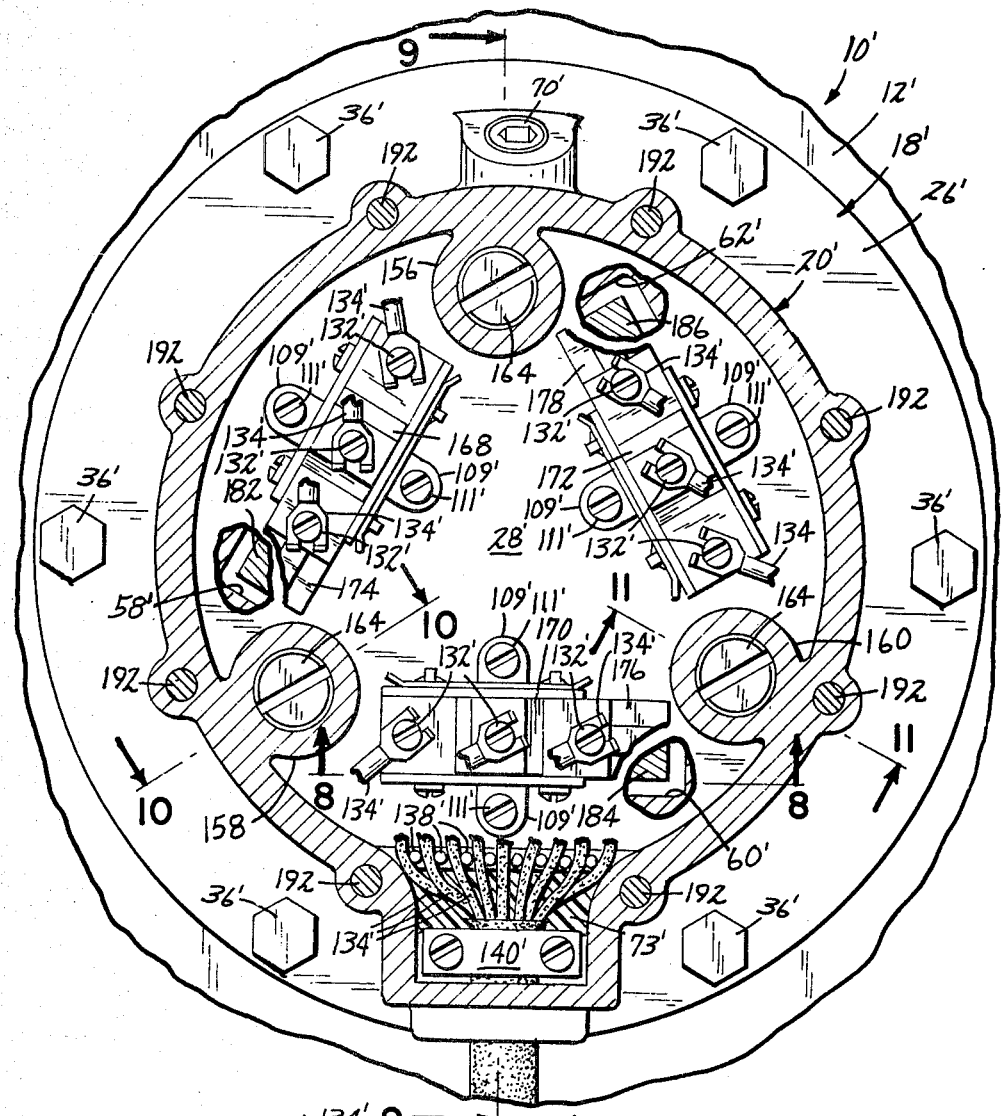
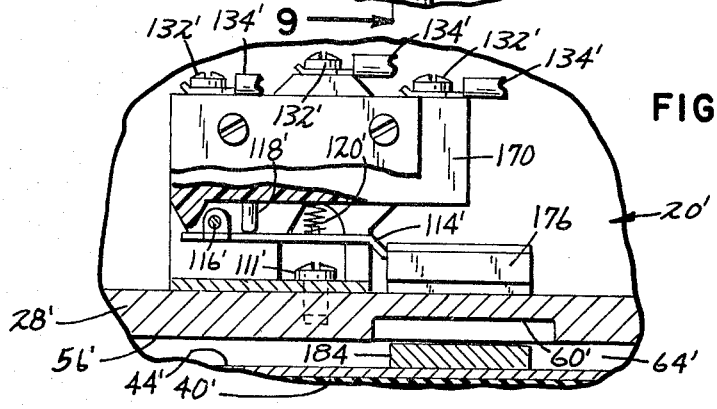
FIG. 8

PRESSURE RESPONSIVE SWITCH DEVICE

TECHNICAL FIELD

The present invention relates broadly to the field of switching mechanisms and more particularly to the field of pressure actuated electrical switching mechanisms. The switch mechanism of the present invention includes a plurality of switches which can be activated at different pressure levels.

BACKGROUND OF THE PRIOR ART

Numerous types of pressure responsive switching mechanisms or devices are known in the prior art. One type of switching device utilizes a pair of magnets to cause the motion of an actuator arm of an electrical switch. One of the magnets is carried by a leaf spring and is disposed in a chamber bounded on one side by a solid wall of casing and on another side by a flexible diaphragm. The motion of the flexible diaphragm moves the first magnet toward the wall of the casing. The second magnet is disposed in the casing adjacent the above-mentioned wall. The two magnets are arranged such that their like poles are directly opposite one another. The motion of the first magnet toward the wall of the casing thus repels the second magnet and activates the actuator arm of the electrical switch. Such a switch mechanism is shown in United States Woolford Pat. No. 3,368,173. A similar system is shown in United States Wolford Pat. No. 3,349,203.

Another type of pressure-actuated switch utilizes a solid plate member as a pressure reactive surface. The plate is spring biased in one direction and is movable against the bias of one or more springs when pressure is applied to the plate. One or more mechanical linkage mechanisms or rods couple the plate to one or more electrical switches. Such switch mechanisms are disclosed in United States Weber Pat. Nos. 3,786,212 and 3,898,405. A mechanical switching mechanism of the type discussed above is also produced by the Automatic Switch Co. of Florham Park, N.J.

SUMMARY OF THE INVENTION

The present invention relates to a switch device which includes a housing and a plurality of switches held therein. A movable member is supported external of the housing and has a first face adapted to face a pressure source and a second face which faces an external wall of the housing. A plurality of first magnets are connected to the movable member at different locations thereon. A plurality of second magnets are supported in the housing. Each of the second magnets is connected to one of the switches for activation of a respective switch. Each of the second magnets is disposed adjacent or in alignment with one of the first magnets to form a plurality of pairs of first and second magnets whereby the motion of one of the first magnets of one of said pairs causes the second magnet of said last-mentioned pair to move and activate one of the switches connected thereto. A plurality of discrete biasing means bias the member away from the wall of the housing. Each biasing means provides a biasing force at a different location on the member. At least two of the biasing means have different biasing forces for biasing different portions of the member away from the housing with different forces.

As pressure is applied to an external face of the movable member, the member moves against the bias of the biasing means. In the preferred embodiment, the movable member is comprised of a collapsible diaphragm and each of the biasing means is comprised of a discrete spring. Each spring is supported within the hollow interior of a cylinder. At least one of the cylinders has a threaded interior and an open outer end. A plug having mating threads threads into the hollow interior and contacts one end of the spring contained in the cylinder. By adjusting the position of the plug in the cylinder, the bias provided by the spring contained therein can also be adjusted.

In one embodiment, two of the biasing springs are utilized and are supported at diametrically opposed locations with respect to the diaphragm. At least two electrical switches are supported in the housing in this embodiment of the device. One of the switches is supported adjacent one of the springs and the other of the switches is supported adjacent the second spring. One of the springs provides less of a biasing force than the other of the springs. Thus, less pressure is required to collapse the first weaker spring. Each pair of magnets is aligned such that the like poles are opposite one another. Thus, when the magnet attached to the diaphragm approaches the end wall, the associated magnet in the housing is repelled and activates the switch to which it is attached. Thus, in this embodiment, as the diaphragm moves toward the wall adjacent the weaker spring, the first switch is activated. As more pressure is applied to an external face of the diaphragm, the second spring begins to collapse and when the second pair of magnets are sufficiently close, the switch associated with the second pair of magnets is activated. The collapsing motion of the diaphragm is generally linear from the weaker spring toward the stronger spring.

In another embodiment, three springs of unequal strength or springs adjusted to each apply a different biasing force are utilized. The springs are preferably spaced at equiangular distances around the perimeter of the diaphragm. Three switches and three pairs of magnets are associated with the three springs are supported within the housing. Since the three springs are of an unequal strength, the diaphragm collapses in a spiral or helical motion around its perimeter from the weakest spring, to the intermediate and finally to the strongest spring.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there are illustrated and described embodiments of the invention.

BRIEF DESCRIPTION OF THE DRAWINGS

FIG. 7 is a sectional view similar to FIG. 3 showing a second embodiment of a switch device in accordance with the present invention;

FIG. 8 is a sectional view taken generally along the line 8—8 of FIG. 7;

DETAILED DESCRIPTION OF THE INVENTION

Figure 1:
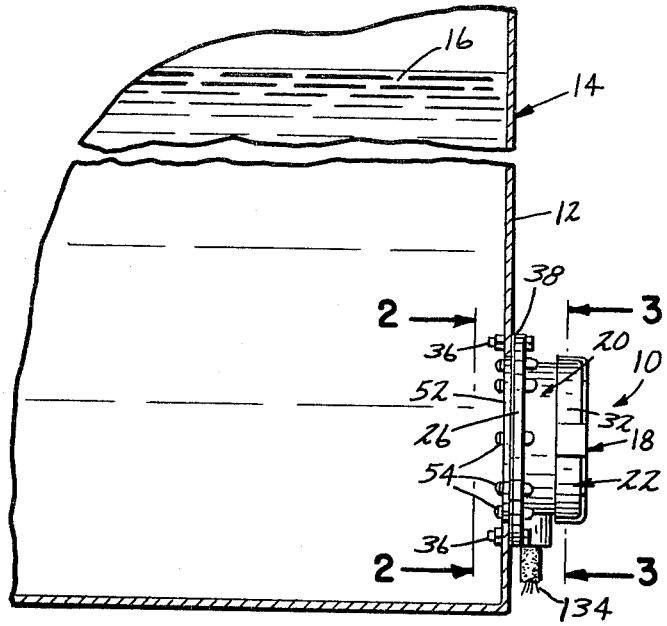
FIG. 1 is a side elevational view, partially in section, illustrating a switch device in accordance with the present invention installed in a vertical wall, of a tank containing a liquid.

Referring to the drawings in detail, wherein like numerals indicate like elements, there is shown in FIG. 1 a pressure responsive switch device designated generally as 10. The switch device 10 is shown attached to a vertical wall 12 of a tank 14. A liquid 16 is held within the tank 14. The pressure which is presented to the switch device 10 is dependent upon the level of the liquid 16 in the tank 14. Other material which acts like a fluid to apply pressure to the device 10 can be contained in the tank 14. Pressure may be applied to the device in manners other than illustrated in FIG. 1.

Figure 2:
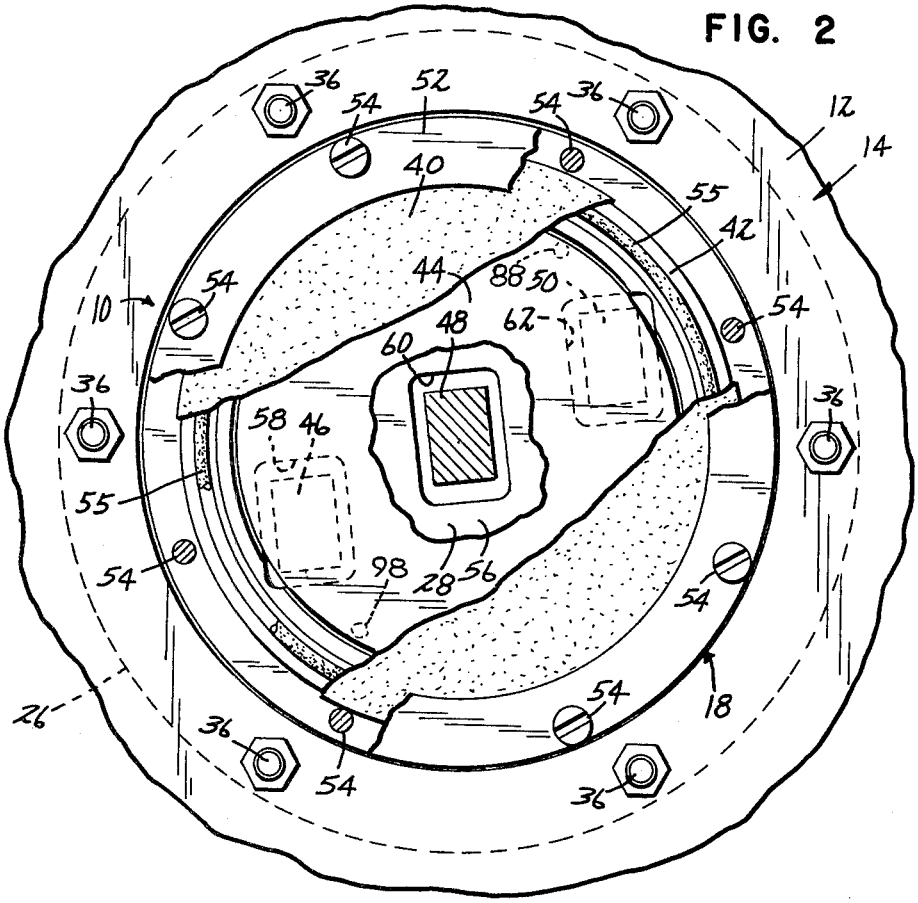
FIG. 2 is a view on an enlarged scale taken generally along line 2—2 of FIG. 1, with portions broken away.
Figure 3:
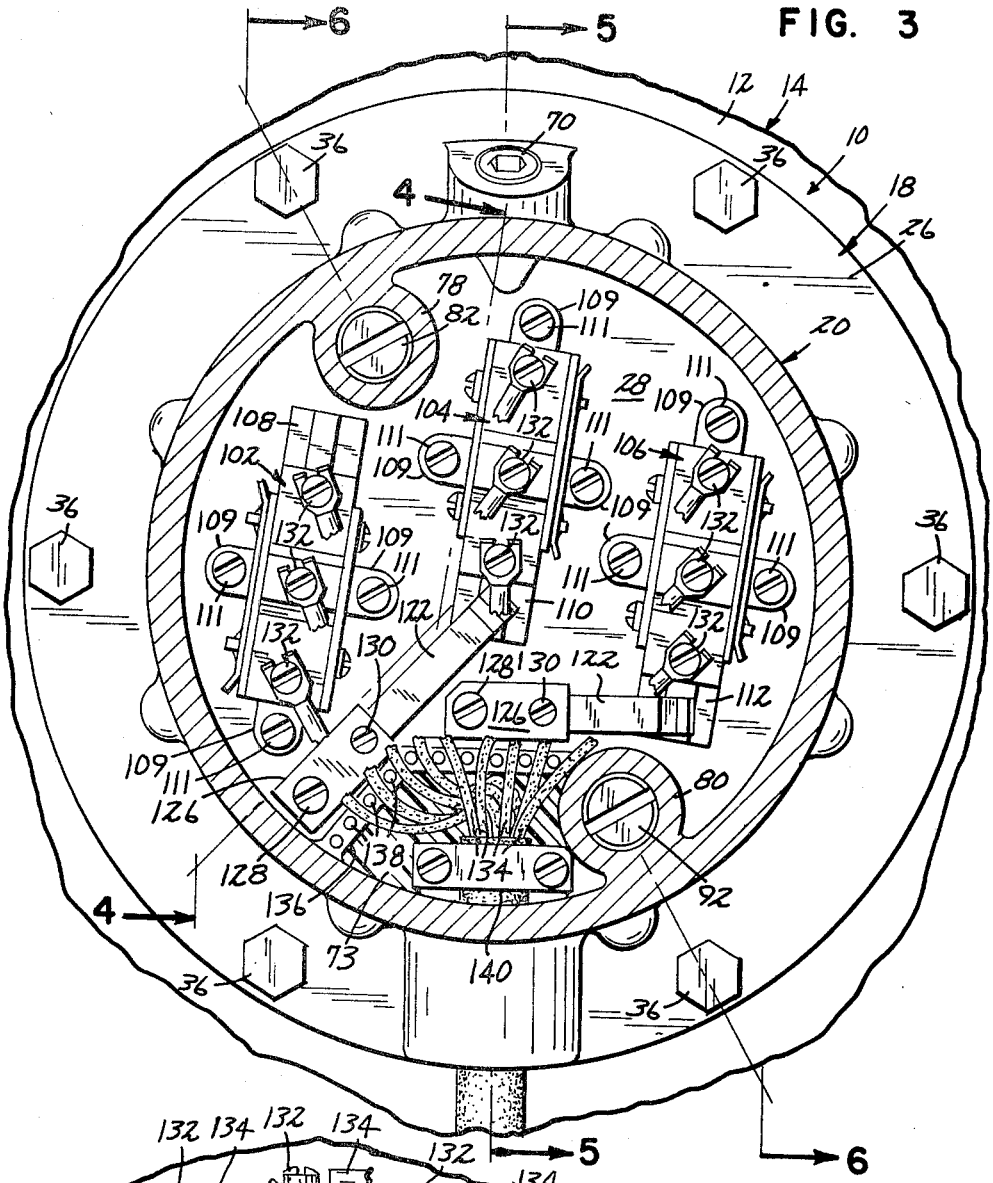
FIG. 3 is a sectional view on an enlarged scale taken generally along line 3—3 of FIG. 1.

The switch device 10 is shown in greater detail in FIGS. 2-6. The switch device 10 includes a housing or casing 18. The housing 18 is made up of a main body portion 20 and a removable top 22. As seen in FIGS. 2 and 3, the body portion 20 and the top 22 have a generally circular configuration. The main body portion 20 has an outer threaded end 24, an annular mounting flange 26, a central section 27 and an inner end wall 28. The removable top 22 has an end wall or face 30 and a ring-shaped section 32. The ring-shaped section 32 has a threaded interior which mates with the thread of the threaded end 24 of the main body portion 20. A ring-shaped gasket 34 is fitted between a beveled end of the threaded end 24 and an inner surface of the top 22. The top 22 is tightened down upon the gasket 34 to form a seal. A portion of the device 10 is received within a hole in the vertical wall 12 and the device 10 is secured thereto by a plurality of nuts and bolts 36 which pass through holes in the annular flange 26 and in the vertical wall 12. A gasket 38 is fitted between the wall 12 and the annular flange 26 to form a seal when the nuts and bolts 36 tighten the flange 26 down toward the wall 12.

A flexible diaphragm 40 is secured to the main body portion 20 adjacent the inner end wall 28. The diaphragm 40 has a generally circular configuration. The diaphragm 40 functions as a member which is movable toward and away from the wall 28. The diaphragm 40 can be made from a variety of synthetic flexible materials dependent upon the environment which the diaphragm 40 will contact. The outer circumferential edge of the diaphragm 40 is secured against an annular beveled surface 42 of the main body portion 20. The annular beveled surface 42 is disposed between the annular flange 26 and the end wall 28. A ring-shaped retainer plate 52 secures the outer circumferential edge of the diaphragm 40 to the beveled edge 42 by a plurality of screws 54 which tighten the retainer plate 52 against the diaphragm 40 and the O-ring 55. A generally circular plate 44 is secured to a major face of the diaphragm 40. A plurality of magnets 46, 48 and 50 are attached at spaced locations to a face of the plate 44.

Figure 5:
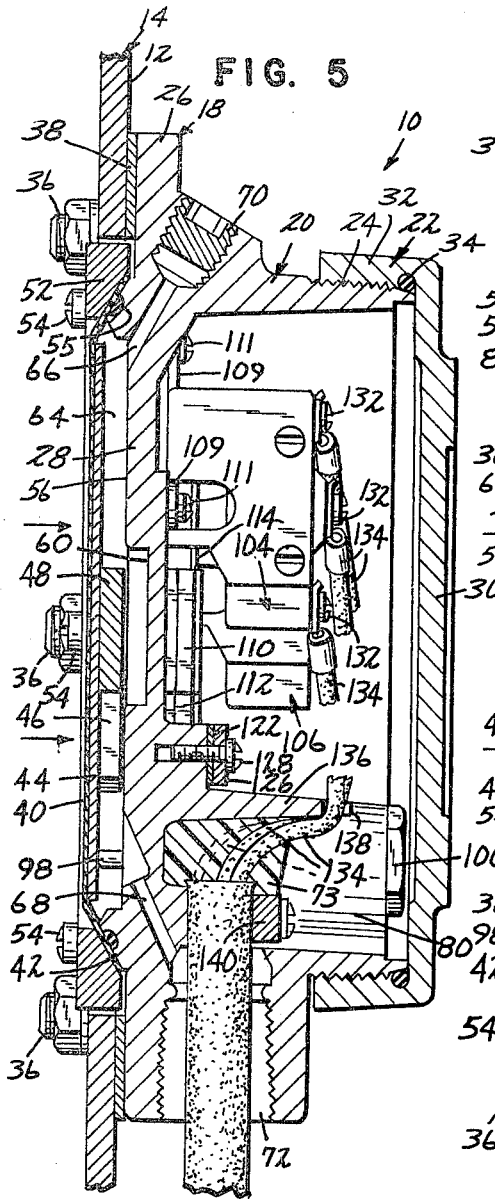
FIG. 5 is a sectional view taken generally along line 5—5 of FIG. 3.
Figure 6:
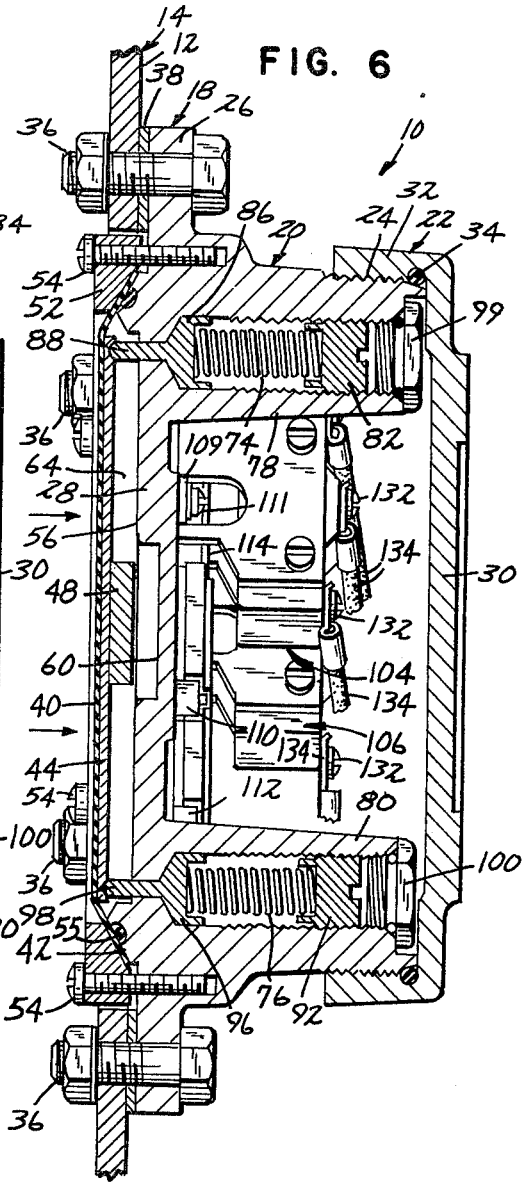
FIG. 6 is a sectional view taken generally along line 6—6 of FIG. 3.
Figure 9:
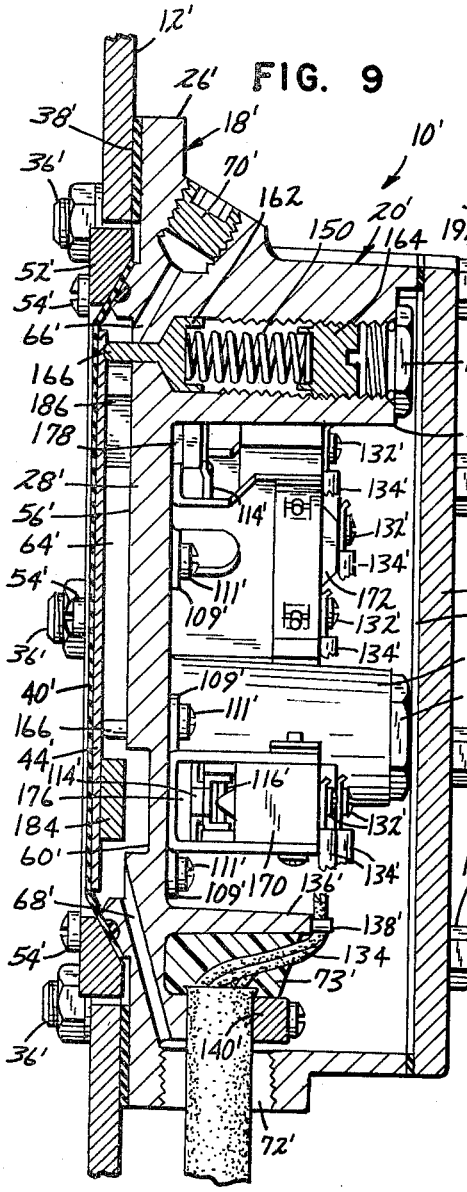
FIG. 9 is a view taken generally along line 9—9 of FIG. 7.
Figure 10:
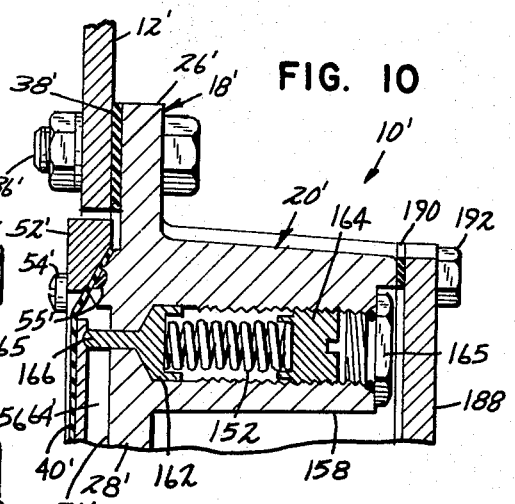
FIG. 10 is a view taken generally along line 10—10 of FIG. 7.
Figure 11:
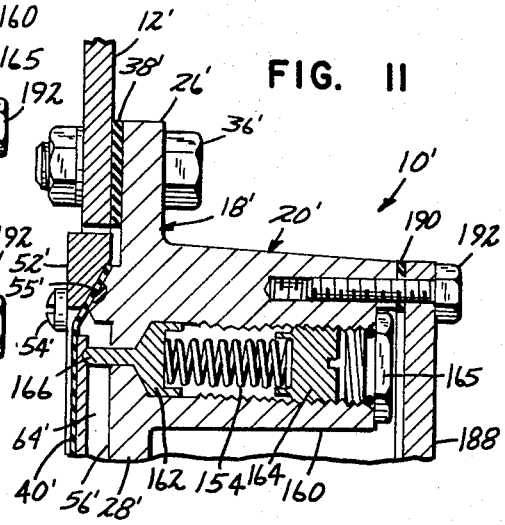
FIG. 11 is a view taken generally along line 11—11 of FIG. 7.

The end wall 28 has an outer surface 56 which faces the diaphragm 40 and plate 44. A plurality of recesses 58, 60 and 62. Each of the recesses 58, 60 and 62 is aligned with one of the magnets 46-50. As the diaphragm 40 moves toward the end wall 28, the magnets 46-50 can move into respective recesses 58-62. A chamber 64 is formed between the diaphragm 40 and the end wall 28. So that air can move in and out of the chamber 64 during the motion of the diaphragm 40, a pair of vent bores 66, 68 are formed through the main body portion 20. As seen in FIG. 5, a plug 70 threads into a portion of the bore 66 to thereby seal it. The bore 68, however, communicates with a wiring aperture 72 which in turn communicates with the surrounding atmosphere.

A biasing means is provided for biasing the diaphragm 40 away from the surface 56 of the end wall 28. The biasing means includes a pair of springs 74, 76. The spring 74 is carried within the hollow interior of a support conduit 78 and the spring 76 is carried within the hollow interior of a support conduit 80. Each of the conduits 78, 80 has a threaded interior wall. Each conduit 78, 80 is preferably formed integral with the main body portion 20 and is disposed within the interior of the housing 18. A first plug 82 threads into the first support conduit 78 and contacts a first end of the spring 74. A second end of the spring 74 is in contact with a moveable finger 86. The finger 86 has a free end 88 which extends through an aperture in the end wall 28 and contacts the plate 44. A second plug 92 threads into the interior of the second support conduit 80 and contacts a first end of the spring 76. A moveable finger 96 is in contact with a second end of the spring 76. A free end 98 of the finger 96 passes through an aperture in the end wall 28 and contacts the plate 40. The springs 74, 76 thus bias the diaphragm 40 away from the surface 56 of the end wall 28. The fingers 86, 96 each have a stop shoulder 101 to prevent the fingers 86, 96 from striking the diaphragm 40 excessively when no pressure is present on the outer face of the diaphragm 40.

A threaded end plug and gasket 99 threads into and seals the hollow interior of the conduit 78 and a threaded end plug and gasket 100 threads into and seals the hollow interior of the conduit 80. So that a portion of the diaphragm 40 adjacent to one of the springs 74, 76 will move inwardly toward the surface of port 56 under less pressure than the portion of the diaphragm 40 adjacent the other of the springs 74, 76, one of the spring 74, 76 applies less of a biasing force to the diaphragm 40. For example, the spring 74 can be selected so that it is weaker than the spring 76. Alternatively, if the springs are of equal strength, the plug 92 could be tightened down upon the spring 76 to a lesser degree than the plug 82 is tightened upon the spring 74. In either case, the plugs 82, 92 can adjust the amount of biasing force applied by the springs which they contact. As will become clearer hereinafter, the utilization of unequal biasing forces permits the switch device 10 to respond to various pressure levels.

A plurality of switches 102, 104 and 106 are supported within the interior of the housing 18. Each switch 102-106 can be attached to an interior surface of the end wall by a clamp 109 and screws 111. The switches 102-106 are preferably conventional on-off microswitches. A magnet 108 is attached to an actuator arm (not shown) of the switch 102. A magnet 110 is attached to an actuator arm 114 of the switch 104. A magnet 112 is attached to an actuator arm (not shown) of the switch 106. The magnet 108 is disposed so as to be in alignment or adjacent the magnet 50; the magnet 110 is disposed so that it is in alignment or adjacent the magnet 48; and the magnet 106 is disposed so that it is in alignment or adjacent the magnet 46. A plurality of aligned pairs of magnets are thus formed. Each pair of magnets 108 and 50, 110 and 48, 112 and 46 is arranged so that their like poles are directly opposite one another. Thus, as a magnet of one of the pairs which is disposed in the chamber 64 approaches the other magnet of the pair disposed in the interior of the housing 18, the magnet within the housing 18 is repelled and the switch coupled thereto is activated.

Figure 4:
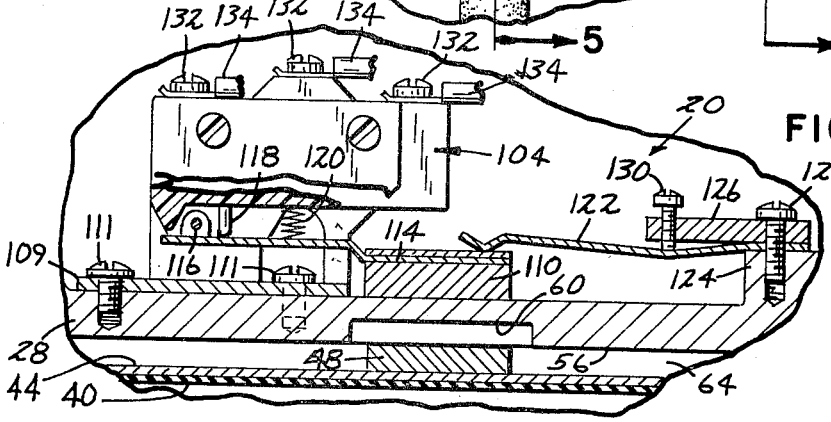
FIG. 4 is a sectional view taken generally along lines 4—4 of FIG. 3.

The switch 104 is shown in detail in FIG. 4, it being understood that the switches 102, 106 are similarly constructed. As seen therein, the actuator arm 114 pivots about an axle pin 116. An actuation pin 118 extends from the switch 104. The switch 104 also includes a small biasing spring 120 which biases the actuator arm 114 downwardly or in a clockwise direction about the pin 116. Thus in its biased position, the actuator arm 114 does not activate the actuation pin 118. To activate switch 104, the actuator arm 114 moves upwardly to contact and move the pin 118. The arm 114 is moved upwardly by means of the magnet 48 moving toward the recess 60. Since like poles of the magnets 48, 110 are aligned, such motion causes the magnet 110 to be repelled from the magnet 48, thereby moving the actuator arm 114 upward.

A leaf spring 122 contacts a top surface of the magnet 110 to provide a downward bias against which the magnet must move to activate the switch 104. The spring 122 is attached to a ridge 124 of the main body portion 20 by means of a clamp bar 126 which is screwed down upon the leaf spring 122 by a screw 128. The clamp 126 extends beyond the edge of the ridge 124 and carries an adjustment screw 130 adjacent its free end. By moving the screw 130 toward or away from the leaf spring 122, the amount of bias applied by the spring 122 on the arm 114 can be adjusted. A fine adjustment as to the amount of pressure which must be applied to the diaphragm 40 in order to activate the switch 104 is thus provided.

A similar leaf spring 122 provides a biasing from to the arm which carries the magnet 112 associated with the switch 106. The switches 102–106 have conventional, normally-open, and normally-closed contacts designated generally as 132. Conductor wires, designated generally as 134, connect the switches 102–106 to external electrical devices for either indication or control purposes. The wires 134 are guided or supported by a support plate 136 having a plurality of projections or fingers 138 extending from its upper surface. The wires 34 are held together by a conventional clamp 140 prior to exiting the device 10 through the aperture 72. A potting or sealing material 73 is placed in the housing above and inwardly of the bore 68 and around the wires 134 to prevent the entry of gases, liquid or dust from the chamber 64 to the interior of the housing 18. Thus, if the membrane 40 should break, the liquid 16 could not enter the interior of the housing 18 via the bore 68.

The switch device 10 operates in the following manner. Pressure is presented to the outer face of the diaphragm 40. In the mode of operation illustrated in FIG. 1, the pressure is applied by the liquid 16 in the tank 14. The amount of pressure applied to the diaphragm 40 depends on the level of the liquid 16. The switch device 10 is designed to sense different levels in the tank 16. When a relatively low level of liquid 16 is present in the tank, the diaphragm 40 presses against the bias of the weaker of the springs 74, 76, for example, spring 76. In this manner, the magnet 46 approaches the magnet 112 to there by repel the magnet 112. The switch 106 is thus activated. The amount of pressure on the diaphragm 40 which is required to activate the switch 106 can be adjusted in various manners. First of all, the strength of the spring 76 can be varied, secondly the biasing force of the selected spring 76 can be adjusted by changing the position of the plug 92, and thirdly, the amount of repelling force presented by the magnet 46 to the magnet 112 can be adjusted by the leaf spring 122 associated with the magnet 112. As the level of the liquid 16 increases, more pressure is applied to the diaphragm 40. The diaphragm 40 begins to move against the bias of the stronger spring, for example, spring 74. If a two-level sensor is desired, the switch 104 can be omitted and a two-switch mechanism utilizing only switches 102 and 106 would be used. Thus, as the diaphragm 40 compresses the spring 74, the switch 102 would be activated when the magnet 50 repels the magnet 108. However, if an intermediate level is to be sensed, the switch 104 is utilized. As the spring 74 is collapsed, the switch 104 will be activated prior to the switch 102 because the magnet 110 is intermediate the magnets 112, 108 in the linear collapsing path of the diaphragm 40. The leaf spring 122, which is associated with the magnet 110, provides a fine adjustment for the amount of repelling force required to repel the magnet 110 and thus activate the switch 104. As the switches 102–106 are activated, external control or indicating devices can be activated through signals received from the wires 134 exiting the device 10.

A second embodiment of a switch device, designated generally as 10', is shown in FIGS. 7–11. Portions of the device 10' which are similar to the device 10 will be indicated by like primed numerals.

The switch device 10' utilizes three springs, 150, 152 and 154 in place of the two springs 74, 76. The spring 150 is supported within the hollow interior of a support conduit 156. The spring 152 is supported within the hollow interior of a support conduit 158 and the spring 154 is supported within the hollow interior of a support conduit 160. As is best seen in FIG. 7, the support conduits 156–160 and the springs 150–154 supported therein are disposed around the inner perimeter of the main body portion 20' of the housing 18'. The support conduits 156–160 are equi-angularly spaced with respect to one another, i.e., they are spaced 120° apart. The springs 150–154 are preferably of unequal strength. Thus, as increasing pressure is applied to the diaphragm 40', the diaphragm 40' moves toward the outer surface 56' of the end wall 28' with a rolling helical motion. That is, the diaphragm 40' will first move inwardly adjacent the weakest spring, thereafter inwardly toward the intermediate spring, and finally inwardly against the bias of the strongest spring.

As in the device 10, moveable fingers 162 contact one edge of each spring 150–154, while the other end of each spring 150–154 contacts a plug 164. Each finger 162 has a free end 166 adapted to contact the plate 44' and the amount of biasing pressure applied by each respective spring 150–154 can be adjusted by positioning an associated plug 164 within the threaded interior of one of the conduits 156–160. A threaded end plug and gasket 165 threads into the open end of each conduit 156–160 to seal the open end. The interior of the housing 18' is sealed by means of a top or outer wall 188 and an annular gasket 190. The wall 188 and the gasket 190 are secured to the main body portion 20° by a plurality of screws 192.

Switches 168, 170 and 172 are positioned within the hollow interior of housing 18' so that their respective magnets 174, 176 and 178 are each disposed adjacent one of the support conduits 156–160. A magnet 182 is disposed within the chamber 64' adjacent the magnet 174. A magnet 184 is disposed in the chamber 64' adjacent the magnet 176 and a magnet 186 is disposed in the chamber 64' adjacent the magnet 178. As with the device 10, a plurality of operatively associated magnet pairs is thus formed. If space permits, more than three switches can be placed in the interior of the housing 18'. An additional pair of magnets would be operatively associated with each additional switch. Such additional switches would be placed along the perimeter of the interior of the housing 18'. The additional switches could thus be activated in serial order as the diaphragm moves inwardly in a helical fashion about its perimeter.

The switch device 10' operates in a manner similar to the device 10 except that the motion of the diaphragm 40' toward the surface 56' is generally a helical, rolling motion progressing from the weakest spring, toward the intermediate spring, and finally toward the strongest spring. In the switch device 10, the motion of the diaphragm 40', as pressure against it increases, is generally linear from the weakest to the strongest spring.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principal of the invention, to the full extent extended by the broad general meaning of the terms in which the appended claims are expressed.

What is claimed is:

1. A switch device for monitoring a fluid pressure source comprising:

a housing;

a plurality of switches supported within said housing;

a movable member supported external of said housing and movable in response to fluid pressure, said member having a first face adapted to face a fluid pressure source and a second face facing an external wall of said housing;

a plurality of first magnets connected to said member at different locations thereon;

a plurality of second magnets supported within said housing, each of said second magnets being connected to one of said switches for activation of a respective switch, and each of said second magnets being disposed adjacent one of said first magnets whereby motion of one of the first magnets causes one of said second magnets to move and activate one of said switches connected thereto; and a plurality of discrete first biasing means for biasing said member away from said wall of said housing, each first biasing means providing a biasing force at a different location on said member, and at least two of said first biasing means having different biasing forces for biasing different portions of said member away from said housing with different forces;

a plurality of second adjustable biasing means supported within said housing and biasing said second magnets to oppose the activation movement of said first magnets.

2. A switch device in accordance with claim 1 wherein said movable member is comprised of a flexible diaphragm.

3. A switch device in accordance with claim 2 wherein each first biasing means is comprised of a discrete spring having a first end operatively connected to said diaphragm and an opposite second end.

4. A switch device in accordance with claim 3 including means for adjusting the biasing force of at least one of said springs.

5. A switch device in accordance with claim 4 wherein said biasing force adjusting means includes a means for holding the second end of one of said springs fixed at a plurality of locations with respect to said first end.

6. A switch device in accordance with claim 5 including a discrete cylinder for supporting each of said springs and wherein said biasing force adjusting means includes a plug threadedly received into a threaded interior of at least one of said the support cylinders and in contact with the second end of a spring carried in said last-mentioned support cylinder whereby the amount said plug is threaded into said last-mentioned cylinder determines the biasing force of the spring in which said plug is in contact.

7. A switch device in accordance with claim 6 wherein each of said support cylinders is formed within said housing, each of said cylinders having an open end for access to said plug, and a removable seal closing each of said open ends of said cylinders.

8. A switch device in accordance with claim 3 or 4 including a cylinder surrounding each of said springs for supporting said springs within said housing.

9. A switch device in accordance with claim 3 or 4 wherein two of said biasing springs are supported at diametrically opposed locations with respect to said diaphragm.

10. A switch device in accordance with claim 9 wherein two of said switches are supported in said housing, one of said switches being supported adjacent first of said springs and the second of said switches being supported adjacent a second of said spring, each of said switches having an actuating arm, one of said second magnets being connected to one of said actuating arms and the other of said second magnets being connected to the other of said actuating arms.

11. A switch device in accordance with claim 10 including a cylinder for supporting each of said springs, the interior of at least of one said cylinders being threaded and including a mating threaded plug for threaded reception into said cylinder to contact a spring supported therein to thereby adjust the spring bias of said last-mentioned spring, and adjustable spring biasing means external of said switch for biasing at least one of said arms away from its switch activating position.

12. A switch device in accordance with claim 10 including a switch supported within said housing at a location between said two of said switches.

13. A switch device in accordance with claim 3 or 4 including three of said springs located at angular spaced distances around the perimeter of said diaphragm.

14. A switch device in accordance with claim 13 wherein said springs are spaced from one another by 120° angular distances.

15. A switch device in accordance with claim 14 including three of said switches, each of said switches being disposed within said housing and adjacent the location of one of said springs, each switch having an actuating arm extending therefrom and one of said second magnets connected thereto.

16. A switch device in accordance with claim 15 wherein each of said springs has a different strength to thereby provide three different biasing forces to said diaphragm.

17. A switch device in accordance with claim 16 including a cylinder for supporting each of said springs, the interior of at least one of said cylinders being threaded and including a mating threaded plug for threaded reception into said last-mentioned cylinder to contact a spring supported therein to thereby adjust the spring bias of said last-mentioned spring.

18. A switch device in accordance with claim 2 wherein said diaphragm is attached to said housing.

19. A switch device in accordance with claim 1 wherein said housing includes a mounting flange extending outwardly along its perimeter.

20. A switch device for monitoring a fluid pressure source comprising:

a housing;

switching means for performing a plurality of switching operations, said switching means being supported within the interior of said housing;

a movable member supported external of and adjacent to said housing and movable in response to fluid pressure;

a plurality of first discrete biasing means for biasing said member away from said housing, each first biasing means providing a biasing force at a different location on said member, at least two of said first biasing means having different biasing forces for biasing different portions of said member away from said housing with different forces;

a plurality of discrete coupling means for coupling the motion of said member to said switching means, each of said magnetic coupling means activating said switching means to perform one of said plurality of switching operations;

a plurality of second discrete biasing means adjustably biasing said switch means in opposition to the activation movement of said magnetic coupling means.

21. A switch device comprising:

a housing having a main body portion, a removable top for removably sealing a first end of said body portion and an inner end wall extending across an opposite end of said body portion;

a flexible diaphragm attached to said housing along its perimeter and having a rigid backplate affixed thereto, a central portion of said diaphragm being held in a spaced relationship from said end wall to form a chamber between an inner surface of said diaphragm and an outer surface of said end wall;

a plurality of springs biasing said diaphragm away from said end wall, each of said springs being operatively connected to said backplate at a different location on said backplate and each of said springs biasing said backplate with a different force;

a plurality of switches supported within the interior of said housing, each of said switches having an actuator arm with a first permanent magnet attached to it, each of said first magnets being held by a respective arm adjacent an inner surface of said inner end wall;

a plurality of second permanent magnets connected to said diaphragm and supported in said chamber, each of said second magnets being aligned with one of said first magnets such that like poles of an aligned pair of first and second magnets are opposite one another;

a plurality of spring members mounted within said housing, each of said spring members disposed for engagement with one of said actuator arms to bias said actuator arm toward its nonactuated position;

means for adjusting the biasing force of said spring members.

22. A switch device in accordance with claim 21 including a plate attached to a major surface of said diaphragm facing said end wall, said second magnets being attached to said plate, one end of each spring being in contact with a discrete finger, each finger having a free end extending through a hole in the end wall of said housing to contact said plate.

23. A switch device in accordance with claim 21 wherein said inner end wall has an outer surface facing the inner surface of said diaphragm, said outer surface of said end wall having a recess for receiving each of said magnets as said magnets move toward said end wall.

24. A switch device in accordance with claim 22 wherein each spring is carried within a support cylinder, each support cylinder being formed integral with said main body portion and extending within the interior of said main body portion, each support cylinder having an open longitudinal end within said hollow interior of said housing and having a removable top for sealing said open end.

25. A switch device in accordance with claim 24 wherein at least one of said support cylinder has a threaded interior with a plug having mating threads for threading into said hollow interior to provide adjustment means for adjusting the bias of the springs supported in said last-mentioned cylinder.

26. A switch device in accordance with claim 25 wherein each of said cylinders has said threaded interior and one of said plugs with mating threads.

27. A switch device in accordance with claim 22 or 24 wherein said plurality of springs include two springs disposed at diametrically opposed locations with respect to the perimeter of said plate.

28. A switch device in accordance with claim 22 or 24 wherein said plurality of springs include three springs disposed at equiangular distances about the perimeter of said plate.

29. A switch device in accordance with claim 21 including an air bleed passageway extending from said chamber to the exterior of said housing.

30. A switch device in accordance with claim 21 wherein said housing includes a flange extending from a perimeter of said housing for mounting said housing to a wall.

31. A switch device in accordance with claim 30 including gasket means on said flange for disposing against a wall to which said flange is to be attached and wherein said diaphragm is disposed inwardly of said gasket and is to be adapted to be received within a hole in the wall to which said flange is attached.

32. A switch device for monitoring a fluid pressure source comprising:

a housing;

a plurality of discrete switching means for performing a plurality of switching operations, each of said plurality of discrete switching means being supported within the interior of said housing;

a movable member supported external of and adjacent to said housing and movable in response to fluid pressure;

first biasing means biasing said member away from said housing;

a plurality of discrete magnetic coupling means for coupling the motion of said member to said switching means, each of said discrete magnetic coupling means associated with one of said discrete switching means, each of said magnetic coupling means activating one of said switching means to perform one of said plurality of switching operations in such a manner that each of said switching operations occurs when different pressures are applied to said movable member;

second adjustable biasing means biasing said switching means toward its nonactuated position in opposition to the activation motion of said movable member.

* * * * *

UNITED STATES PATENT AND TRADEMARK OFFICE

CERTIFICATE OF CORRECTION

PATENT NO. : 4,273,976

DATED : June 16, 1981

INVENTOR(S) : Byron F. Wolford, John F. Rose, James Thunselle

It is certified that error appears in the above-identified patent and that said Letters Patent are hereby corrected as shown below:

In column 9, line 40, insert --magnetic-- before "coupling means".

Signed and Sealed this

*Fifteenth* Day of *September 1981*

[SEAL]

*Attest:*

GERALD J. MOSSINGHOFF

*Attesting Officer*

*Commissioner of Patents and Trademarks*